US007619543B1

(12) United States Patent
Todinca

(10) Patent No.: US 7,619,543 B1
(45) Date of Patent: Nov. 17, 2009

(54) GARAGE PARKING MAT

(76) Inventor: Marius G. Todinca, 12690 NW. 11th Pl., Sunrise, FL (US) 33323

( * ) Notice: Subject to any disclaimer, the term of this patent is extended or adjusted under 35 U.S.C. 154(b) by 230 days.

(21) Appl. No.: 11/939,025

(22) Filed: Nov. 13, 2007

(51) Int. Cl.
*G08G 1/14* (2006.01)

(52) U.S. Cl. ..... 340/932.2; 340/933; 340/944; 340/908; 340/436; 340/691.6; 242/379; 242/385.1; 242/376; 242/377; 428/137; 428/156; 428/172; 428/188; 116/28 R; 116/173

(58) Field of Classification Search ..... 340/932.2, 340/933, 944, 908, 436, 691.6; 242/379, 242/385.1, 376, 377; 428/137, 156, 172, 428/188; 116/28 R, 173
See application file for complete search history.

(56) References Cited

U.S. PATENT DOCUMENTS

| | | | | |
|---|---|---|---|---|
| 4,015,235 | A | 3/1977 | Demaine et al. | |
| 4,464,648 | A | 8/1984 | Smith et al. | |
| 4,856,896 | A | 8/1989 | Farr | |
| 5,285,205 | A | 2/1994 | White | |
| 6,062,162 | A | 5/2000 | Dean | |
| 6,120,876 | A * | 9/2000 | Walton | 428/137 |
| D436,881 | S | 1/2001 | Sloven | |
| 6,515,586 | B1 * | 2/2003 | Wymore | 340/541 |
| 7,021,237 | B1 * | 4/2006 | Benjamin | 116/28 R |
| 2006/0179671 | A1 | 8/2006 | Ghatak | |

* cited by examiner

*Primary Examiner*—Tai T Nguyen
(74) *Attorney, Agent, or Firm*—Crossley Patent Law; Mark A. Crossley

(57) ABSTRACT

A garage parking mat that assists an individual in properly parking their vehicle in a garage. The parking mat is fabricated from two durable rubber mats, sensors, a warning light box, insulated wiring, and various attached hardware. The rubber mats are adjustable in length and include lateral strips across the front and rear on each mat. Within the strips are pressure sensors that are designed to notify the attached hardware when a vehicle's tires are located on a pressure sensor. The strips also have a series of sensors located on the outer edges of each rubber mat to detect improper steering by a driver. The warning light box includes a series of lights, including a red and green light, to visually signal a driver when the driver is pulling a vehicle into the garage.

10 Claims, 3 Drawing Sheets

GARAGE PARKING MAT

BACKGROUND OF THE INVENTION

The present invention concerns that of a new and improved garage parking mat that would assist an individual in properly parking their vehicle in a garage.

SUMMARY OF THE INVENTION

The present invention concerns that of a new and improved garage parking mat that would assist an individual in properly parking their vehicle in a garage. The parking mat is fabricated from two durable rubber mats, sensors, a warning light box, insulated wiring, and various attached hardware. The rubber mats are adjustable in length and include lateral strips across the front and rear on each mat. Within the strips are pressure sensors that are designed to notify the attached hardware when a vehicle's tires are located on a pressure sensor. The strips also have a series of sensors located on the outer edges of each rubber mat to detect improper steering by a driver. The warning light box includes a series of lights, including a red and green light, to visually signal a driver when the driver is pulling a vehicle into the garage.

There has thus been outlined, rather broadly, the more important features of a garage parking mat that the detailed description thereof that follows may be better understood and in order that the present contribution to the art may be better appreciated. There are, of course, additional features of the garage parking mat that will be described hereinafter and which will form the subject matter of the claims appended hereto.

In this respect, before explaining at least one embodiment of the garage parking mat in detail, it is to be understood that the garage parking mat is not limited in its application to the details of construction and to the arrangements of the components set forth in the following description or illustrated in the drawings. The garage parking mat is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present garage parking mat. It is important, therefore, that the claims be regarded as including such equivalent constructions insofar as they do not depart from the spirit and scope of the present invention.

It is therefore an object of the present invention to provide a garage parking mat which has all of the advantages of the prior art and none of the disadvantages.

It is another object of the present invention to provide a garage parking mat which may be easily and efficiently manufactured and marketed.

It is another object of the present invention to provide a garage parking mat which is of durable and reliable construction.

It is yet another object of the present invention to provide a garage parking mat which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
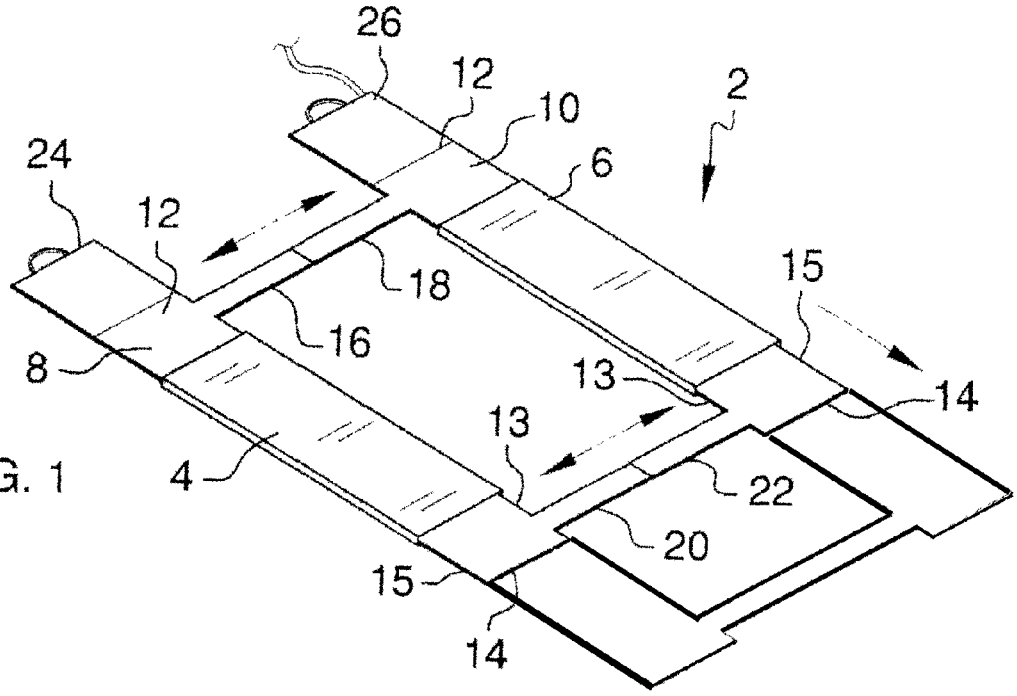
FIG. 1 shows a perspective view of the garage parking mat as it would appear in use.
Figure 2:
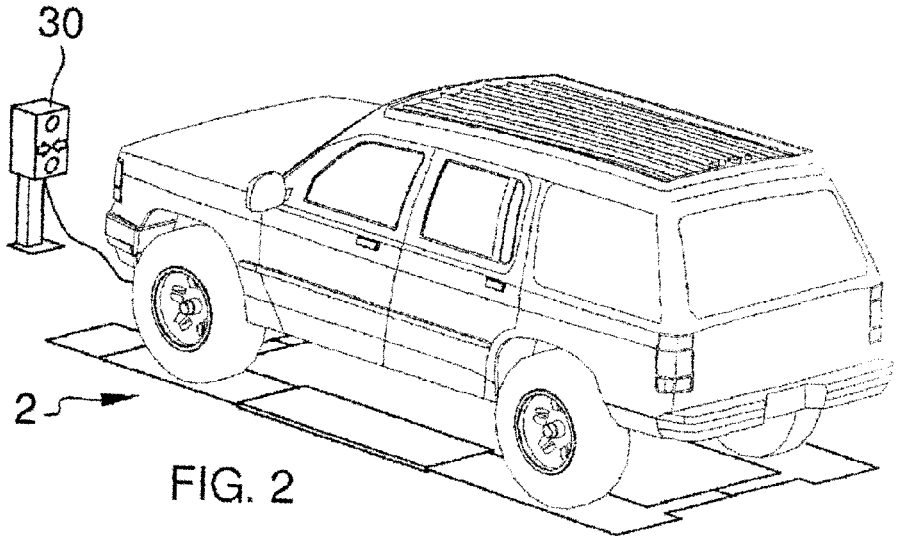
FIG. 2 shows a perspective view of the garage parking mat as it would appear in use with a vehicle located on it.
Figure 3:
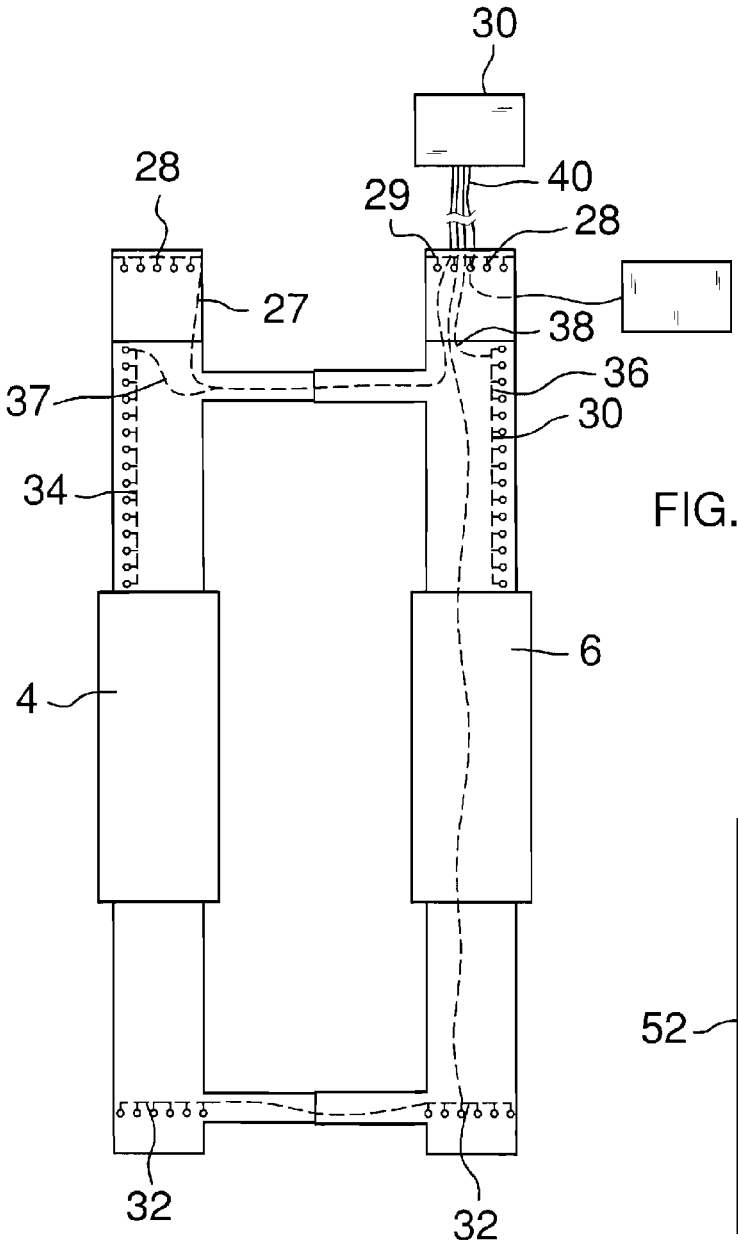
FIG. 3 shows a top view of the garage parking mat as it would appear in use, highlighting the sensors and electronics of the garage parking mat.
Figure 4:
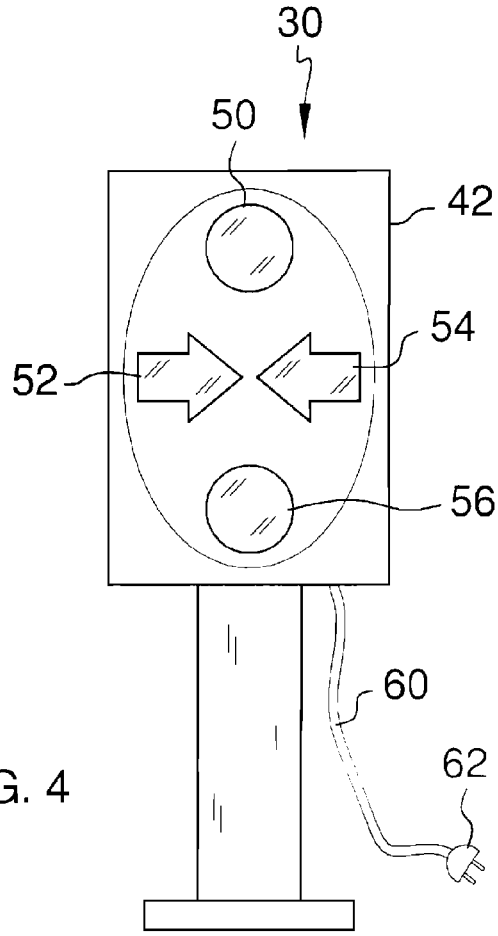
FIG. 4 shows a front view of the warning light box of the garage parking mat.
Figure 5:
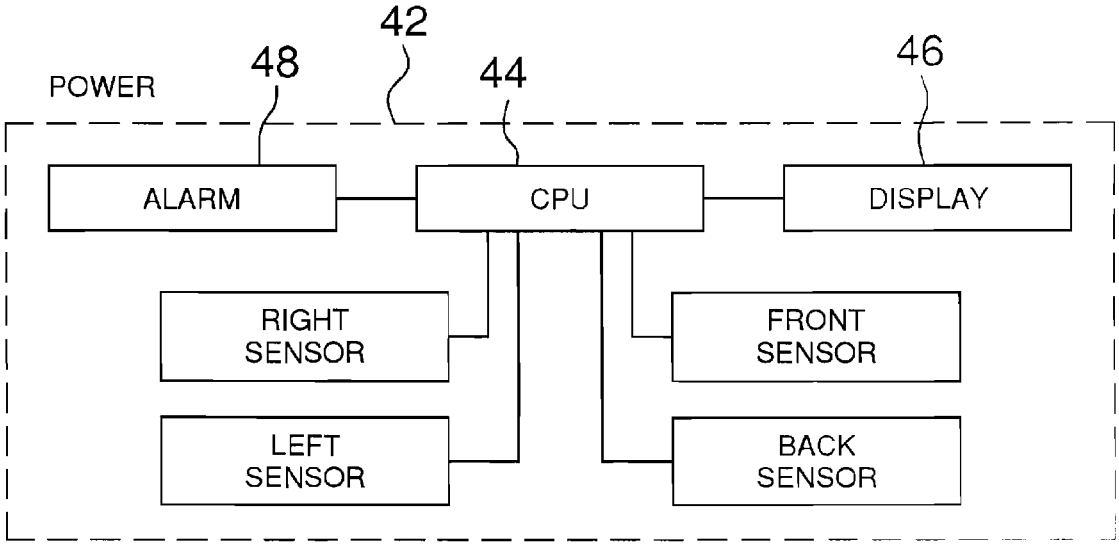
FIG. 5 shows an electronic schematic diagram of the various components and how they are connected to one another.

With reference now to the drawings, and in particular to FIGS. 1 through 5 thereof, a new garage parking mat embodying the principles and concepts of the present invention and generally designated by the reference numeral 2 will be described.

As best illustrated in FIGS. 1 through 5, the garage parking mat 2 comprises a pair of tubular, rectangular rubber mats 4 and 6. Mat 4 is positioned on the left side, while mat 6 is positioned on the right side. The two mats 4 and 6 serve as a basic skeletal framework for the present invention. The two mats 4 and 6 have a rectangular cross-sectional shape and are hollow.

A pair of adjustable length mats 8 and 10 are associated with the rubber mats 4 and 6. Adjustable length mat 8 is associated with and inserted through rubber mat 4, while adjustable length mat 10 is associated with and inserted through rubber mat 6. Each of the mats 8 and 10 have two ends comprising a front end 12 and a rear end 14, and furthermore, have two sides comprising an inner side 13 and an outer side 15. Adjustable length mat 8 is inserted through mat 4 and can be expanded or retracted to make sure that a particular vehicle's left tires are properly located on the adjustable length mat 8. Adjustable length mat 10 is inserted through mat 6 and can be expanded or retracted to make sure that a particular vehicle's right tires are properly located on the adjustable length mat 10.

The front end 12 of adjustable length mat 8 has an inward extension 16 that is connected to an inward extension 18 that is connected to the front end 12 of adjustable length mat 10. Furthermore, the rear end 14 of adjustable length mat 8 has an inward extension 20 that is connected to an inward extension 22 that is connected to the rear end 14 of adjustable length mat 10. All of the inward extensions 16-22 are connected to the inner side 13 of their respective adjustable length mats. As a result of the connections between the two sets of inward extensions, the two adjustable mats can be adjusted so as to be closer to one another or further away, depending on the width of a particular vehicle that might be using the garage parking mat 2.

A lateral strip 24 is attached to the front end 12 of the adjustable length mat 8, while a lateral strip 26 is attached to the front end 12 of the adjustable length mat 10. Each of these lateral strips 24 and 26 have a plurality of pressure sensors 28 that are electronically connected to a light display unit 30 that is electronically attached via wires 27 and 29, respectively. Furthermore, the rear end of both the adjustable length mat 8 and the adjustable length mat 10 have a plurality of pressure sensors 32 that are also electronically connected to a light display unit 30 that is electronically attached.

A plurality of side pressure sensors 34 are located along the outer side 15 toward the front end 12 of the adjustable length mat 8, while a plurality of side pressure sensors 36 are located along the outer side 15 toward the front end 12 of the adjustable length mat 8. Each of the pluralities of pressure sensors 34 and 36 are designed to warn a driver if he or she veers too far off to the side while parking a vehicle on the garage parking mat 2 and each of the pluralities are independently connected to the light display unit 30. The plurality of side pressure sensors 34 is connected to the light display unit 30 via wire 37, while the plurality of side pressure sensors 36 is connected to the light display unit 30 via wire 38.

The light display unit 30 is connected to all the sensors within the garage parking mat 2 via a wire 40 and has an outer casing 42 which houses its various components. The light display unit 30 comprises a central processing unit 44 which is connected to a visual display 46 and an alarm 48. Each of the various sets of sensors are independently connected to the central processing unit 44.

Externally, the light display unit 30 has a red light 50, a pair of inward arrows 52 and 54, and a green light 56. The garage parking mat 2, as a whole, will indicate to a driver driving a vehicle on the garage parking mat 2 that he may drive forward by displaying the green light 56. Once the vehicle puts pressure on the pressure sensors 28 and 30 within the lateral sensors 24 and 26, said sensors will notify the central processing unit 44, which will then cause the red light 50 brighten, notifying the driver to stop his vehicle.

If a driver is moving his vehicle forward over the garage parking mat 2 and runs over the plurality of side pressure sensors 34 that are located along the outer side 15 of the adjustable length mat 8 toward the front end 12 of the adjustable length mat 8, inward arrow 52 will brighten up, indicating a driver should move a little more to the right while continuing to move his vehicle forward. Similarly, if a driver is moving his vehicle forward over the garage parking mat 2 and runs over the plurality of side pressure sensors 36 that are located along the outer side 15 of the adjustable length mat 10 toward the front end 12 of the adjustable length mat 10, inward arrow 54 will brighten up, indicating a driver should move a little more to the left while continuing to move his vehicle forward.

The garage parking mat 2 is preferably powered by power means 60, which preferably is standard household current 62. The garage parking mat 2 is also timed, so that after about one to two minutes after a vehicle is in place and is not moving, the light display unit 30 will turn off.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A garage parking mat comprising (a) a pair of rubber mats comprising a left mat and a right mat, each mat of the pair of rubber mats having a rectangular cross-sectional shape, each mat of the pair of rubber mats being hollow, (b) a pair of adjustable length mats comprising a left adjustable length mat and a right adjustable length mat, each of the adjustable length mats having two ends comprising a front end and a rear end, each of the adjustable length mats further including two sides comprising an inner side and an outer side, wherein the left adjustable length mat is inserted through the left mat, further wherein the right adjustable length mat is inserted through the right mat, (c) means for electronically monitoring a placement of a vehicle that is driven onto the garage parking mat, wherein means for electronically monitoring the placement of a vehicle that is driven onto the garage parking mat further comprises:

a first plurality of side pressure sensors located along the outer side of the left adjustable length mat toward the front end of the left adjustable length mat, a second plurality of side pressure sensors located along the outer side of the right adjustable length mat toward the front end of the right adjustable length mat, means for notifying an individual if he or she drives a vehicle over a sensor part of the first plurality of side pressure sensors, and means for notifying an individual if he or she drives a vehicle over a sensor part of the second plurality of side pressure sensors and (d) means for connected the left adjustable length mat to the right adjustable length mat.

2. A garage parking mat according to claim 1 wherein the means for connected the left adjustable length mat to the right adjustable length mat further comprises (a) a left upper inward extension attached to the inner side of the left adjustable length mat near the front end of the left adjustable length mat, (b) a right upper inward extension attached to the inner side of the right adjustable length mat near the front end of the right adjustable length mat, (c) a left lower inward extension attached to the inner side of the left adjustable length mat near the rear end of the left adjustable length mat, (d) a right lower inward extension attached to the inner side of the right adjustable length mat near the rear end of the right adjustable length mat, (e) wherein the left upper inward extension is adjustably attached to the right upper inward extension, and (f) further wherein the left lower inward extension is adjustably attached to the right lower inward extension.

3. A garage parking mat according to claim 2 wherein the means for electronically monitoring the placement of a vehicle that is driven onto the garage parking mat further comprises (a) a pair of lateral strips comprising a left lateral strip and a right lateral strip, wherein the left lateral strip is attached to the front end of the left adjustable length mat, further wherein the right lateral strip is attached to the front end of the right adjustable length mat, (b) a first plurality of sensors located within the left lateral strip, (c) a second plurality of sensors located within the left lateral strip, and (d) means for notifying an individual when either the first plurality of sensors or the second plurality of sensors are activated by pressure from a vehicle.

4. A garage parking mat according to claim 3 wherein the means for notifying an individual when either the first plurality of sensors or the second plurality of sensors are activated by pressure from a vehicle further comprises (a) a light display unit, (b) at least one wire connecting the light display unit to each of the plurality of sensors located within the left lateral strip and the right lateral strip, and (c) power means for providing power to the light display unit.

5. A garage parking mat according to claim 4 wherein the light display unit further comprises (a) an outer casing, (b) a central processing unit located within the outer casing, (c) a visual display connected to the central processing unit, the visual display being located on the outer casing, the visual display comprising a series of lights, and (d) an audible alarm connected to the central processing unit.

6. A garage parking mat according to claim 5 wherein the series of lights on the visual display further comprises (a) a red light, and (b) a green light.

7. A garage parking mat according to claim 1 wherein the means for notifying an individual if he or she drives a vehicle over a sensor part of the first plurality of side pressure sensors further comprises (a) a left inward arrow located on the visual display of the light display unit, (b) at least one wire attached to at least one of the side pressure sensors that is part of the first plurality of side pressure sensors, (c) wherein the wire is connected to the left inward arrow, (d) further wherein activating at least one sensor of the first plurality of side pressure sensor causes the left inward arrow to light up, thereby notifying an individual that he or she has driven a vehicle over a sensor part of the first plurality of side pressure sensors.

8. A garage parking mat according to claim 7 wherein the means for notifying an individual if he or she drives a vehicle over a sensor part of the second plurality of side pressure sensors further comprises (a) a right inward arrow located on the visual display of the light display unit, (b) at least one wire attached to at least one of the side pressure sensors that is part of the second plurality of side pressure sensors, (c) wherein the wire is connected to the right inward arrow, (d) further wherein activating at least one sensor of the second plurality of side pressure sensor causes the right inward arrow to light up, thereby notifying an individual that he or she has driven a vehicle over a sensor part of the second plurality of side pressure sensors.

9. A garage parking mat according to claim 8 wherein the power means for providing power to the light display unit further comprises standard household current.

10. A garage parking mat comprising (a) a pair of rubber mats comprising a left mat and a right mat, each mat of the pair of rubber mats having a rectangular cross-sectional shape, each mat of the pair of rubber mats being hollow, (b) a pair of adjustable length mats comprising a left adjustable length mat and a right adjustable length mat, each of the adjustable length mats having two ends comprising a front end and a rear end, each of the adjustable length mats further including two sides comprising an inner side and an outer side, wherein the left adjustable length mat is inserted through the left mat, further wherein the right adjustable length mat is inserted through the right mat, (c) means for electronically monitoring the placement of a vehicle that is driven onto the garage parking mat, said means comprising (i) a pair of lateral strips comprising a left lateral strip and a right lateral strip, wherein the left lateral strip is attached to the front end of the left adjustable length mat, further wherein the right lateral strip is attached to the front end of the right adjustable length mat, (ii) a first plurality of sensors located within the left lateral strip, (iii) a second plurality of sensors located within the left lateral strip, (iv) means for notifying an individual when either the first plurality of sensors or the second plurality of sensors are activated by pressure from a vehicle, said means further comprising (1) a light display unit, the light display unit further comprising an outer casing, the light display unit further comprising a central processing unit located within the outer casing, the light display unit further comprising a visual display connected to the central processing unit, the visual display being located on the outer casing, the visual display comprising a series of lights, the series of lights including a red light and a green light, the light display unit further comprising an audible alarm connected to the central processing unit, (2) at least one wire connecting the light display unit to each of the plurality of sensors located within the left lateral strip and the right lateral strip, and (3) power means for providing power to the light display unit, said power means preferably comprising standard household current, (v) a first plurality of side pressure sensors located along the outer side of the left adjustable length mat toward the front end of the left adjustable length mat, (vi) a second plurality of side pressure sensors located along the outer side of the right adjustable length mat toward the front end of the right adjustable length mat, (vii) means for notifying an individual if he or she drives a vehicle over a sensor part of the first plurality of side pressure sensors, said means comprising (1) a left inward arrow located on the visual display of the light display unit, (2) at least one wire attached to at least one of the side pressure sensors that is part of the first plurality of side pressure sensors, (3) wherein the wire is connected to the left inward arrow, (4) further wherein activating at least one sensor of the first plurality of side pressure sensor causes the left inward arrow to light up, thereby notifying an individual that he or she has driven a vehicle over a sensor part of the first plurality of side pressure sensors, and (viii) means for notifying an individual if he or she drives a vehicle over a sensor part of the second plurality of side pressure sensors, said means comprising (1) a right inward arrow located on the visual display of the light display unit, (2) at least one wire attached to at least one of the side pressure sensors that is part of the second plurality of side pressure sensors, (3) wherein the wire is connected to the right inward arrow, (4) further wherein activating at least one sensor of the second plurality of side pressure sensor causes the right inward arrow to light up, thereby notifying an individual that he or she has driven a vehicle over a sensor part of the second plurality of side pressure sensors, and (d) means for connected the left adjustable length mat to the right adjustable length mat, said means further comprising (i) a left upper inward extension attached to the inner side of the left adjustable length mat near the front end of the left adjustable length mat, (ii) a right upper inward extension attached to the inner side of the right adjustable length mat near the front end of the right adjustable length mat, (iii) a left lower inward extension attached to the inner side of the left adjustable length mat near the rear end of the left adjustable length mat, (iv) a right lower inward extension attached to the inner side of the right adjustable length mat near the rear end of the right adjustable length mat, (v) wherein the left upper inward extension is adjustably attached to the right upper inward extension, (vi) further wherein the left lower inward extension is adjustably attached to the right lower inward extension.

* * * * *